US011828532B2

(12) United States Patent
Day

(10) Patent No.: US 11,828,532 B2
(45) Date of Patent: Nov. 28, 2023

(54) METHOD AND APPARATUS FOR TRANSFER OF LIQUID

(71) Applicant: L'Air Liquide, Societe Anonyme pour l'Etude et l'Exploitation des Procedes Georges Claude, Paris (FR)

(72) Inventor: Eric Day, Hangzhou (CN)

(73) Assignee: L'Air Liquide Societe Anonyme Pour L'Etude Et L'Exploitation Des Procedes Georges Claude, Paris (FR)

( * ) Notice: Subject to any disclaimer, the term of this patent is extended or adjusted under 35 U.S.C. 154(b) by 73 days.

(21) Appl. No.: 17/138,927

(22) Filed: Dec. 31, 2020

(65) Prior Publication Data

US 2022/0205715 A1 Jun. 30, 2022

(51) Int. Cl.
*F25J 3/02* (2006.01)
*F25J 3/04* (2006.01)

(52) U.S. Cl.
CPC ..... *F25J 3/04812* (2013.01); *F25J 3/048* (2013.01); *F25J 3/04666* (2013.01); *F25J 2205/90* (2013.01); *F25J 2280/02* (2013.01)

(58) Field of Classification Search
CPC .. F25J 3/04; F25J 3/04812; F25J 3/048; F25J 3/04648; F25J 3/04654; F25J 3/0466; F25J 3/04666; F25J 3/04709; F25J 3/02721; F25J 3/04727; F25J 3/04763; F25J 3/04781; F25J 3/04806; F25J 3/04824; F25J 3/0483; F25J 3/04836; F25J 3/04842; F25J 2280/00; F25J 2280/02; F25J 2280/10; F25J 2205/90
See application file for complete search history.

(56) References Cited

U.S. PATENT DOCUMENTS

| | | | | |
|---|---|---|---|---|
| 5,019,145 A * | 5/1991 | Rohde | F25J 3/04412 62/646 |
| 5,305,611 A * | 4/1994 | Howard | F25J 3/04412 62/651 |
| 6,269,659 B1 * | 8/2001 | De Bussy | F25J 3/04303 62/648 |
| 2007/0199344 A1 | 8/2007 | Howard | |
| 2011/0146344 A1 * | 6/2011 | Ha | F25J 3/04296 62/645 |
| 2013/0086941 A1 * | 4/2013 | Howard | F25J 3/0423 62/643 |

FOREIGN PATENT DOCUMENTS

| | | |
|---|---|---|
| EP | 0 952 415 | 10/1999 |
| FR | 2 943 773 | 10/2010 |

OTHER PUBLICATIONS

EP Search Report and Written Opinion for EP 21 21 5650, dated May 17, 2022.

* cited by examiner

*Primary Examiner* — Brian M King
(74) *Attorney, Agent, or Firm* — Justin K. Murray

(57) ABSTRACT

A method and apparatus for transferring a first liquid removed from an outlet of a first distillation column to an inlet of a second distillation column is provided. The second distillation column operates at a higher pressure than the first distillation column, and the inlet of the second distillation column is at higher elevation as compared to the outlet of the first distillation column. The method advantageously transfers the first liquid from the outlet to the inlet by mixing with a sufficient amount of a lower density second liquid that results in a mixed liquid having a reduced density as compared to the first liquid.

10 Claims, 2 Drawing Sheets

METHOD AND APPARATUS FOR TRANSFER OF LIQUID

TECHNICAL FIELD OF THE INVENTION

The present invention generally relates to a method and apparatus for transferring a liquid from a removal point of a first distillation column to an inlet point of a second distillation column without the use of a pump or compressor, wherein the inlet point is higher than the first location, and the first distillation column operates at a lower pressure than the second distillation column.

BACKGROUND OF THE INVENTION

Air separation plants separate atmospheric air into its primary constituents: nitrogen and oxygen, and occasionally argon, xenon and krypton. These gases are sometimes referred to as air gases.

A typical cryogenic air separation process can include the following steps: (1) filtering the air in order to remove large particulates that might damage the main air compressor; (2) compressing the pre-filtered air in the main air compressor and using interstage cooling to condense some of the water out of the compressed air; (3) passing the compressed air stream through a front-end-purification unit to remove residual water and carbon dioxide; (4) cooling the purified air in a heat exchanger by indirect heat exchange against process streams from the system of cryogenic distillation columns; (5) introducing the cold air into the system of distillation columns for rectification therein; (6) collecting nitrogen from the top of one of the columns (typically as a gas) and collecting oxygen from the bottom of another column as a liquid.

For air separation units (ASUs) that produce argon, it is typical for a stream to be removed from a lower pressure column that is part of a double column (e.g., the lower pressure column being surmounted on top of a higher pressure column and sharing a common condenser/reboiler) and then sent to an argon column (or a system of argon columns). This stream is ideally withdrawn at a location of the lower pressure column in order to optimize argon recovery, while also minimizing the amount of nitrogen in the stream, so that the argon column is operated with the goal of separating argon and oxygen.

Additionally, there are sometimes instances during operation in which argon recovery is not desired (e.g., reduced local demand for argon and/or the liquid argon storage tank is full); however, shutting down the argon column(s) would be undesirable, since restarting the argon column(s) is time consuming and also disturbing to the refrigeration balance of the entire system, thereby temporarily upsetting production of the produced air gases (e.g., nitrogen and/or oxygen)

As such, methods known heretofore can either continue running the argon column(s) while venting the produced argon product, which incurs ongoing operational expenditures of running the column(s), or shut down the argon portion of the plant to save on operational expenditures at the expense of a longer start-up procedure when argon production is desired.

Therefore, there is a need for an improved design and method of operating said design that will allow for being able to efficiently switch between two different modes of operating a plant that also allows the plant to resume normal operations without an extended start-up period.

SUMMARY OF THE INVENTION

The present invention is directed to a method and apparatus that satisfies at least one of these needs.

In one embodiment, a method for operating an air separation plant having a higher-pressure column, a lower-pressure column, and an argon column, in which the air separation plant has a first mode of operation and a second mode of operation is provided. In one embodiment, the method can include the steps of: withdrawing an argon-enriched fluid from the lower-pressure column and introducing said argon-enriched fluid to the argon column; withdrawing an argon-enriched liquid from a first location of the argon column; and withdrawing a liquid nitrogen stream from a third location of the higher-pressure column and introducing the liquid nitrogen stream, after expansion in a valve, to a second location of the lower-pressure column, wherein the second location is at a higher elevation than the third location.

In certain preferred embodiments, during first mode of operation, the method further includes the step of sending the argon-enriched liquid withdrawn from the first location of the argon column to a liquid storage tank or to a fourth column configured to further refine the argon-enriched liquid. Additionally, during the second mode of operation, the method can include the steps of mixing the argon-enriched liquid from the first location of the argon column with the liquid nitrogen stream at a mixing location that is at a lower elevation than the first location to form a mixed fluid and then introducing the mixed fluid to the second location, wherein the mixed fluid is introduced to the second location without the use of a pump.

In optional embodiments of the method for operating the air separation plant:

- the step of mixing the argon-enriched liquid further comprises adjusting a flow rate of the argon-enriched liquid being mixed with the liquid nitrogen stream at the mixing location using a second valve;
- the second valve is disposed between the first location and the mixing location;
- the step of mixing the argon-enriched liquid further comprises adjusting a flow rate of the argon-enriched liquid sent from the first location of the argon column to the liquid storage tank or to the fourth column using an argon production valve;
- the method is switched from the first mode of operation to the second mode of operation upon a determination that a reduction in liquid argon is needed;
- the method is switched from the first mode of operation to the second mode of operation by closing an argon production valve and opening a second valve, wherein the argon production valve is configured to adjust a flow rate of the argon-enriched liquid sent from the first location of the argon column to the liquid storage tank or to the fourth column, wherein the second valve is configured to adjust a flow rate of the argon-enriched liquid mixed with the liquid nitrogen stream;
- the liquid nitrogen stream is mixed with the argon-enriched liquid in an amount sufficient to lower the density of the mixed fluid thereby allowing the mixed fluid to move from the mixing location to the second location without the use of the pump; and/or
- the lower-pressure column is surmounted on the higher pressure column and the lower-pressure column and the higher-pressure column share a common condenser/reboiler.

In another embodiment, a method for transferring a first fluid from a first column to a second column, wherein the first column is at a lower operating pressure than the second column, is provided. The method can include the steps of: withdrawing the first fluid from a first location of the first column; mixing the first fluid with a second fluid at a mixing location that is at a lower elevation than the first location to form a mixed fluid, wherein the second fluid has a lower density than the first fluid; and introducing the mixed fluid to a second location that is at a top portion of the second column, wherein the second location is at a higher elevation than the first location, wherein the mixed fluid is introduced to the second location without the use of a pump.

In optional embodiments of the method for transferring a first fluid from the first column to the second column:

- the second fluid is withdrawn from a third location of a third column prior to mixing with the first fluid, wherein the third column is at a higher operating pressure than the second column, wherein the third location is at a lower elevation than the second location;
- the second fluid is mixed with the first fluid in an amount sufficient to lower the density of the mixed fluid thereby allowing the mixed fluid to move from the mixing location to the second location without the use of the pump;
- the first column is an argon column and the first fluid is an argon-enriched liquid; and/or
- the second column is a lower-pressure column and the third column is a higher pressure column, wherein the lower-pressure column is surmounted on the higher pressure column and the lower-pressure column and the higher-pressure column share a common condenser/reboiler.

In another embodiment, an air separation plant that is configured to operate in a first mode of operation and a second mode of operation is provided. In certain embodiments, the apparatus can include: a double column system having a higher-pressure column surmounted by a lower-pressure column, wherein a second location of the lower-pressure column is configured to receive a liquid nitrogen stream from a third location of the higher-pressure column following expansion in a valve; an argon production unit in fluid communication with the lower-pressure column, wherein the argon production unit is configured to receive an argon-enriched fluid from the lower-pressure column.

In certain embodiments, the argon production unit is configured to operate at a lower pressure than the lower-pressure column; wherein during first mode of operation, the argon production unit is configured to transfer liquid argon to a liquid storage tank. In certain embodiments, during the second mode of operation, a first location of the argon production unit is configured to be in fluid communication with a mixing location, such that the air separation plant is configured to mix an argon-enriched fluid from the argon production unit with the liquid nitrogen stream from the higher-pressure column at the mixing location. Additionally, the mixing location can be disposed between second location and the third location, wherein the mixing location is at a lower elevation than the second location and the first location. Furthermore, the apparatus preferably includes an absence of a pump or equivalent disposed between the first location and the second location.

In optional embodiments of the apparatus for operating in a first and second mode:

- the apparatus can include means for switching from the first mode of operation to the second mode of operation;
- the means for switching from the first mode of operation to the second mode of operation a mixing valve, wherein the mixing valve is configured to adjust a flow rate of the argon-enriched liquid mixed with the liquid nitrogen stream; and/or
- the mixing valve is configured to adjust the flow rate of the argon-enriched liquid such that the resulting mixed fluid has a sufficiently reduced density as compared to the argon-enriched liquid such that the mixed fluid can move from the mixing location to the second location without the use of the pump.

In one embodiment, the invention can include an improved method for transferring a first liquid removed from an outlet of a first distillation column to an inlet of a second distillation column. The second distillation column operates at a higher pressure than the first distillation column, and the inlet of the second distillation column is at higher elevation as compared to the outlet of the first distillation column. The method advantageously transfers the first liquid from the outlet to the inlet by mixing in a sufficient amount of a lower density second liquid (or by mixing the higher density fluid into a lower density fluid) that results in a mixed liquid having a reduced density as compared to the first liquid. In a preferred embodiment, the lower density liquid is a nitrogen liquid withdrawn from the higher pressure column that is located below the second distillation column (i.e., the lower pressure column).

In a preferred embodiment, the improved method includes an absence of using a cryogenic pump to transfer the first liquid from the outlet to the inlet, or at a minimum, by using the lower density second liquid, a smaller cryogenic pump can be used to achieve the transfer of the first liquid.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated by those skilled in the art that the conception and specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims. The novel features which are believed to be characteristic of the invention, both as to its organization and method of operation, together with further objects and advantages will be better understood from the following description when considered in connection with the accompanying Figure. It is to be expressly understood, however, that the Figure is provided for the purpose of illustration and description only and is not intended as a definition of the limits of the present invention

BRIEF DESCRIPTION OF THE DRAWINGS

These and other features, aspects, and advantages of the present invention will become better understood with regard to the following description, claims, and accompanying drawings. It is to be noted, however, that the drawings illustrate only several embodiments of the invention and are therefore not to be considered limiting of the invention's scope as it can admit to other equally effective embodiments.

DETAILED DESCRIPTION

While the invention will be described in connection with several embodiments, it will be understood that it is not intended to limit the invention to those embodiments. On the contrary, it is intended to cover all the alternatives, modifications and equivalence as may be included within the spirit and scope of the invention defined by the appended claims.

Figure 1:
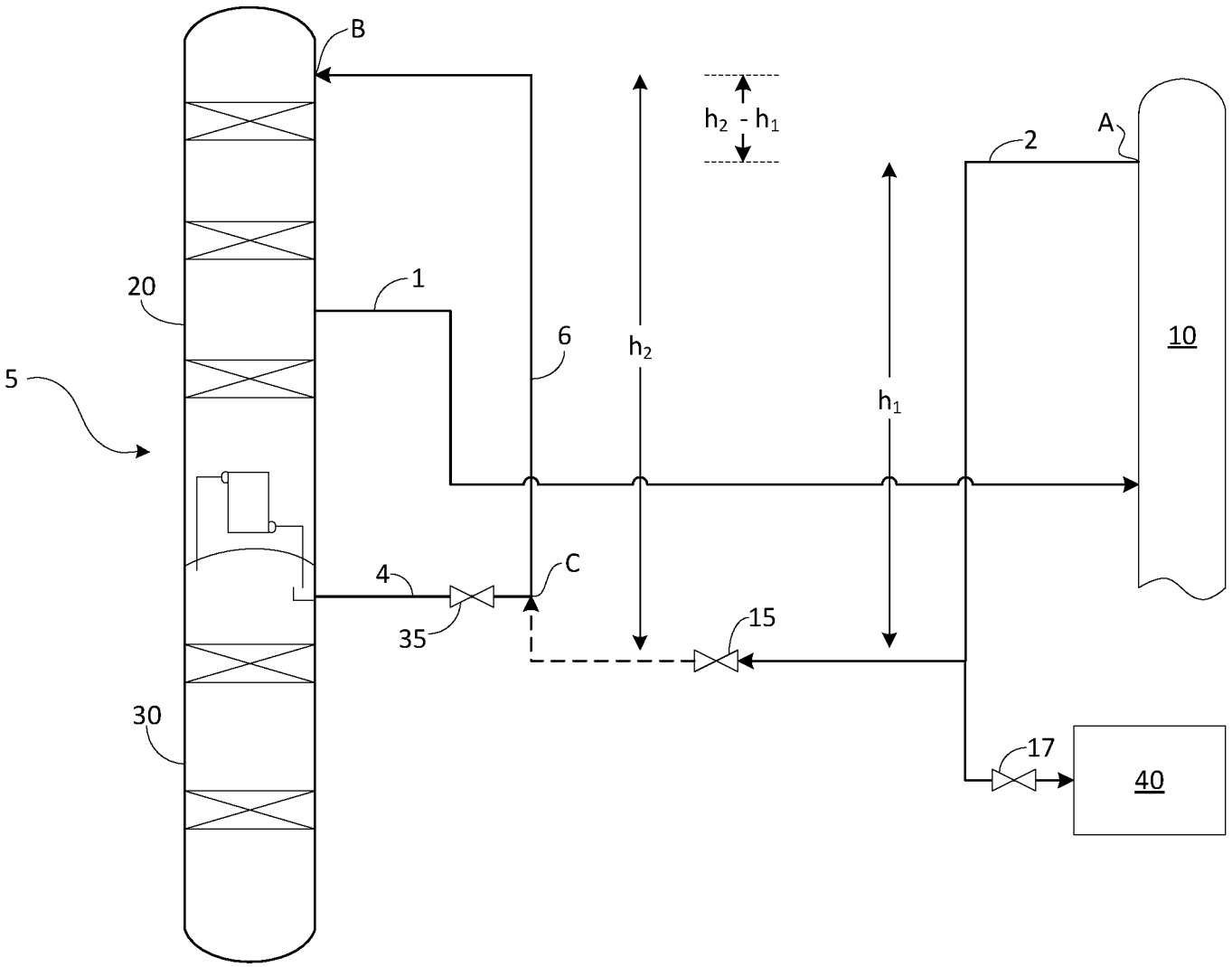
FIG. 1 provides an embodiment of the present invention.

In FIG. 1, which represents a normal mode of operation, liquid nitrogen 4 is withdrawn from the higher-pressure column 30 and then expanded across valve 35 before being transferred to inlet point B of the lower-pressure column 20 via pipe 6. Of particular note is an absence of a pump or other similar external pressurizing device disposed between valve 35 and inlet point B. The pressure differential between the lower-pressure column and the higher-pressure column preferably provides the driving force for transferring the liquid nitrogen from the higher-pressure column and the lower-pressure column.

In the normal mode of operation, argon-enriched fluid 1 is withdrawn from lower-pressure column 20 and introduced to argon column 10, which is configured to purify argon from oxygen, thereby producing an argon-enriched liquid at the top of the argon column. This argon-enriched liquid can be withdrawn from the argon column at outlet point A and transported via line 2 through open valve 17 and to unit 40, which can be either liquid argon storage or a second argon column should further purification be needed.

During normal operation, it is preferable to have no flow of the argon-enriched liquid from the argon column 10 to the lower-pressure column 20. In the embodiment shown in FIG. 1, this can be accomplished by keeping mixing valve 15 closed while valve 17 is left fully open, thereby allowing full transport of the argon-enriched liquid from the argon column 10 to the unit 40.

Figure 2:
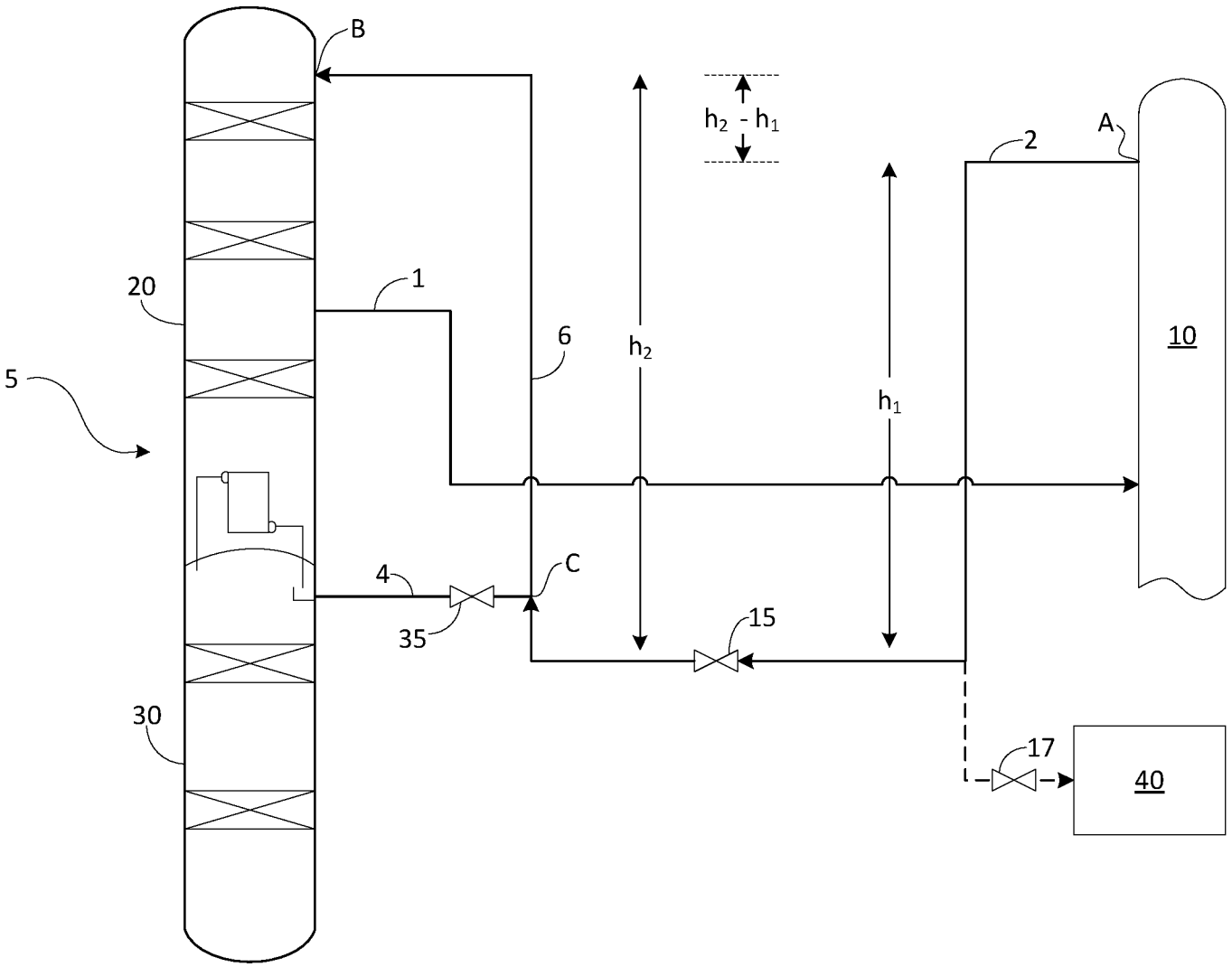
FIG. 2 provides a second embodiment of the present invention.

In FIG. 2, which represents a second mode of operation (e.g., a reduced argon production mode), argon-enriched liquid is still withdrawn from first location A of argon column 10; however, instead of sending all of the liquid to unit 40, at least some of the argon-enriched liquid is sent via piping 2 to mixing point C by at least partially opening valve 15. The Argon-enriched liquid is then mixed at point C with nitrogen-enriched liquid 4, which is withdrawn from the higher pressure column 30 of a double column 5, to form a mixed liquid. The nitrogen-enriched liquid has a lower density than the argon-enriched liquid, thereby resulting in the mixed liquid having a density that is lower than the argon-enriched liquid.

The mixed liquid is then transferred from point C to inlet point B, which is located at a top portion of the lower pressure column 20. As is shown in FIG. 2, there is no cryogenic pump located between outlet point A and inlet point B. In another embodiment of the present invention, the invention can include a cryogenic pump located between outlet point A and inlet point B, preferably upstream of point C and downstream outlet point A. However, because of the presence of the lower density nitrogen-enriched liquid 4, the optional cryogenic pump may be smaller and therefore use less energy during operation as compared to an embodiment that does not mix the lower density liquid with the first liquid, since the cryogenic pump will not have to pressurize the fluid as much to make the transfer.

While it may seem counterintuitive to be able to transfer a liquid from a lower elevation and at a lower static pressure without use of a pump (or a smaller pump), embodiments of the invention overcome this problem by an innovative use of Bernoulli's equation, in which:

$$\frac{1}{2}\rho v^2 + \rho g z + p = \text{constant}$$

-continued or:

$$q + \rho g h = p_0 + \rho g z = \text{constant}$$

where $q = \frac{1}{2}\rho v^2$ is dynamic pressure;

$h = z + \frac{p}{\rho g}$ is the piezometric head or hydraulic head (the sum of the elevation $z$ and the pressure head)

$p_0 = p + q$ is the stagnation pressure (the sum of the static pressure $p$ and the dynamic pressure $q$.

Based on these principles, when the density of the mixed liquid is sufficiently lowered, the differences in elevation and static pressure between points A and B can be overcome. In certain embodiments, it can be advantageous to maximize the heights of the two columns in order to maximize the benefit of the density differences between the mixed liquid and the first liquid (e.g., argon-enriched liquid in the example shown).

When looking at the embodiment shown in FIG. 2, if the system is observed with first valve 15 as a reference point, the upstream pressure of first valve 15 is equal to the static pressure plus the hydrostatic pressure (less the pressure drop of the line 2). Further, the downstream pressure is equal to the static pressure plus the hydrostatic pressure and less the pressure drop of line 6. So long as the pressure upstream of the first valve 15 exceeds the pressure downstream of the first valve 15, the fluid within lines 2 and 6 will flow successfully from outlet point A to inlet point B.

Working Example

A computer simulation was conducted based on an air separation plant as shown generally in the Figures (those of ordinary skill in the art will recognize that the process flow diagrams shown in the Figures are greatly simplified and does not include many flow stream and process equipment for the sake of simplicity). Table I includes the inputs and resulting flows required to achieve successful transfer.

TABLE I

| Working Examples | | |
|---|---|---|
| | Example 1 | Example 2 |
| Operating Pressure of Argon Column (bara) | 1.232 | 1.017 |
| Operating Pressure of LP Column (bara) | 1.293 | 1.176 |
| Operating Pressure of HP Column (bara) | 5.127 | 4.641 |
| Elevation Point A (m) | 25.21 | 49.09 |
| Elevation Point B (m) | 26.37 | 56.3 |
| Elevation Point C (m) | 7.3 | 7.3 |
| h1 | 19.14 | 41.34 |
| h2 | 20.3 | 48.55 |
| Density of First Liquid ($kg/m^3$) | 1380 | 1392.6 |
| Density of Second Liquid ($kg/m^3$) | 780 | 771.9 |
| Density of Mixed Liquid at Point C ($kg/m^3$) | 796.5 | 783.1 |
| Molar Flow Rate First Liquid (Nm3/h) | 629 | 2740 |

TABLE I-continued

| Working Examples | | |
|---|---|---|
| | Example 1 | Example 2 |
| Molar Flow Rate Second Liquid (Nm3/h) | 16776 | 76971 |
| Molar Flow Rate Mixed Liquid (Nm3/h) | 17405 | 79711 |

Additionally, in the computer simulation shown, the pressure upstream and downstream of valve 35 was 5.37 bara and 2.7 bara, respectively. Table II includes the compositions of streams 2, 4, and 6 for an embodiment of the invention in which argon production is reduced (e.g., second mode of operation with valve 15 opened and valve 17 closed).

TABLE II

| Composition of Streams 2, 4, and 6 | | | |
|---|---|---|---|
| | Stream 2 | Stream 4 | Stream 6 |
| Nitrogen | 0.2% | 98.8% | 96.2% |
| Oxygen | — | 0.1% | — |
| Argon | 99.8% | 0.1% | 3.7% |

Embodiments of the present invention advantageously allow for the argon column(s) to continue operating at cryogenic temperatures, even during reduced argon demand, by sending the argon-enriched liquid to an upper section of the lower-pressure column. This allows for improved restart of argon production once desired, since the columns are kept at cryogenic temperatures. Additionally, by introducing the argon-enriched liquid to the top portion of the lower-pressure column, production of nitrogen and oxygen is largely unchanged from the double column system since the argon is largely vented out the top of the lower-pressure column with the nitrogen waste gas. Moreover, since no mechanical compression device is used to transfer the argon-enriched liquid from the argon column(s) to the lower-pressure column, the second mode of operation does not need added CAPEX or OPEX associated with a cryogenic compressor/pump.

Those of ordinary skill in the art will recognize that certain streams, such as a liquid oxygen stream, a waste nitrogen gas stream, and a liquid nitrogen stream, all of which may be withdrawn from the double column system 5 are not shown for simplicity. Their omission is not intended to mean that they are not included in certain embodiments of the present invention.

While the description of the Figures makes specific references to an air separation columns system using an argon-enriched liquid being mixed with a nitrogen-enriched liquid, embodiments of the invention are not necessarily so limited. Rather, those of ordinary skill in the art will recognize that the invention can also apply to any multi-column system in which a first liquid is transferred from an outlet of the first column to an inlet of the second column, and the elevation difference and pressure difference of the two columns is overcome by mixing in a lower density liquid.

The terms "nitrogen-enriched," "oxygen-enriched," or "argon-enriched" will be understood by those skilled in the art to be in reference to the composition of air. As such, nitrogen-enriched encompasses a fluid having a nitrogen content greater than that of air. Similarly, oxygen-enriched encompasses a fluid having an oxygen content greater than that of air, and argon-enriched encompasses a fluid having an argon content greater than that of air.

While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims. The present invention may suitably comprise, consist or consist essentially of the elements disclosed and may be practiced in the absence of an element not disclosed. Furthermore, if there is language referring to order, such as first and second, it should be understood in an exemplary sense and not in a limiting sense. For example, it can be recognized by those skilled in the art that certain steps can be combined into a single step.

The singular forms "a", "an" and "the" include plural referents, unless the context clearly dictates otherwise.

"Comprising" in a claim is an open transitional term which means the subsequently identified claim elements are a nonexclusive listing (i.e., anything else may be additionally included and remain within the scope of "comprising"). "Comprising" as used herein may be replaced by the more limited transitional terms "consisting essentially of" and "consisting of" unless otherwise indicated herein.

"Providing" in a claim is defined to mean furnishing, supplying, making available, or preparing something. The step may be performed by any actor in the absence of express language in the claim to the contrary.

Optional or optionally means that the subsequently described event or circumstances may or may not occur. The description includes instances where the event or circumstance occurs and instances where it does not occur.

Ranges may be expressed herein as from about one particular value, and/or to about another particular value. When such a range is expressed, it is to be understood that another embodiment is from the one particular value and/or to the other particular value, along with all combinations within said range.

All references identified herein are each hereby incorporated by reference into this application in their entireties, as well as for the specific information for which each is cited.

I claim:

1. A method for operating an air separation plant having a higher-pressure column, a lower-pressure column, and an argon column, the air separation plant having a first mode of operation and a second mode of operation, the method comprising the steps of:

withdrawing an argon-enriched fluid from the lower-pressure column and introducing said argon-enriched fluid to the argon column;

withdrawing an argon-enriched liquid from a first location of the argon column; and withdrawing a liquid nitrogen stream from a third location of the higher-pressure column and introducing the liquid nitrogen stream, after expansion in a valve, to a second location of the lower-pressure column, wherein the second location is at a higher elevation than the third location, wherein during first mode of operation, the method further comprises the step of sending the argon-enriched liquid withdrawn from the first location of the argon column to a liquid storage tank or to a fourth column configured to further refine the argon-enriched liquid, wherein during the second mode of operation, the method further comprises the steps of mixing the argon-enriched liquid from the first location of the argon column with the liquid nitrogen stream at a mixing location that is at a lower elevation than the first location to form a mixed fluid and then introducing the mixed fluid to the second location, wherein the mixed fluid is introduced to the second location without the use of a pump, wherein the method is switched from the first mode of operation to the second mode of operation by closing an argon production valve and opening a previously closed second valve for mixing the argon-enriched liquid with the nitrogen-enriched liquid.

2. The method as claimed in claim 1, wherein the step of mixing the argon-enriched liquid further comprises adjusting a flow rate of the argon-enriched liquid being mixed with the liquid nitrogen stream at the mixing location using the second valve.

3. The method as claimed in claim 2, wherein the second valve is disposed between the first location and the mixing location.

4. A method for operating an air separation plant having a higher-pressure column, a lower-pressure column, and an argon column, the air separation plant having a first mode of operation and a second mode of operation, the method comprising the steps of:

withdrawing an argon-enriched fluid from the lower-pressure column and introducing said argon-enriched fluid to the argon column;

withdrawing an argon-enriched liquid from a first location of the argon column; and withdrawing a liquid nitrogen stream from a third location of the higher-pressure column and introducing the liquid nitrogen stream, after expansion in a valve, to a second location of the lower-pressure column, wherein the second location is at a higher elevation than the third location, wherein during first mode of operation, the method further comprises the step of sending the argon-enriched liquid withdrawn from the first location of the argon column to a liquid storage tank or to a fourth column configured to further refine the argon-enriched liquid, wherein during the second mode of operation, the method further comprises the steps of mixing the argon-enriched liquid from the first location of the argon column with the liquid nitrogen stream at a mixing location that is at a lower elevation than the first location to form a mixed fluid and then introducing the mixed fluid to the second location, wherein the mixed fluid is introduced to the second location without the use of a pump, wherein the step of mixing the argon-enriched liquid further comprises adjusting a flow rate of the argon-enriched liquid being mixed with the liquid nitrogen stream at the mixing location using a second valve, wherein the step of mixing the argon-enriched liquid further comprises adjusting a flow rate of the argon-enriched liquid sent from the first location of the argon column to the liquid storage tank or to the fourth column using an argon production valve.

5. The method as claimed in claim 1, wherein the method is switched from the first mode of operation to the second mode of operation upon a determination that a reduction in liquid argon is desired.

6. The method as claimed in claim 4, wherein the method is switched from the first mode of operation to the second mode of operation by closing an argon production valve and opening a previously closed second valve for mixing the argon-enriched liquid with the nitrogen-enriched liquid.

7. The method as claimed in claim 1, wherein the liquid nitrogen stream is mixed with the argon-enriched liquid in an amount sufficient to lower the density of the mixed fluid thereby allowing the mixed fluid to move from the mixing location to the second location without the use of the pump.

8. The method as claimed in claim 1, wherein the lower-pressure column is surmounted on the higher pressure column and the lower-pressure column and the higher-pressure column share a common condenser/reboiler.

9. An air separation plant configured to operate in a first mode of operation and a second mode of operation, the apparatus comprising:

a double column system having a higher-pressure column surmounted by a lower-pressure column, wherein a second location of the lower-pressure column is configured to receive a liquid nitrogen stream from a third location of the higher-pressure column following expansion in a valve;

an argon production unit in fluid communication with the lower-pressure column, wherein the argon production unit is configured to receive an argon-enriched fluid from the lower-pressure column, wherein the argon production unit is configured to operate at a lower pressure than the lower-pressure column, wherein the argon production unit comprises an argon column and liquid argon storage;

wherein during first mode of operation, the argon production unit is configured to transfer liquid argon to a liquid storage tank, wherein during the second mode of operation, a first location of the argon production unit is configured to be in fluid communication with a mixing location, such that the air separation plant is configured to mix an argon-enriched fluid from the argon production unit with the liquid nitrogen stream from the higher-pressure column at the mixing location, wherein the mixing location is disposed between the second location and the third location, wherein the mixing location is at a lower elevation than the second location and the first location, wherein the apparatus further comprises an absence of a pump disposed between the first location and the second location, wherein the apparatus is switched from the first mode of operation to the second mode of operation by closing an argon production valve and opening a previously closed mixing valve for mixing the argon-enriched liquid with the nitrogen-enriched liquid.

10. The apparatus as claimed in claim 9, wherein the mixing valve is configured to adjust the flow rate of the argon-enriched liquid to be mixed with the liquid nitrogen stream resulting in a mixed fluid that has sufficiently reduced density reduced density as compared to the argon-enriched liquid such that the mixed fluid can move from the mixing location to the second location without the use of the pump.

* * * * *